US009177507B2

(12) United States Patent
Wei et al.

(10) Patent No.: US 9,177,507 B2
(45) Date of Patent: Nov. 3, 2015

(54) INTENSITY COMPENSATION METHOD AND DISPLAY CONTROL DEVICE AND IMAGE DISPLAY DEVICE APPLYING THE SAME

(71) Applicants: Novatek (Shanghai) Co., Ltd., Shanghai (CN); NOVATEK Microelectronics Corp., Hsin-Chu (TW)

(72) Inventors: Min Wei, Guangdong (CN); Heng Yu, Shanghai (CN); Jiande Jiang, Shaanxi (CN)

(73) Assignees: Novatek (Shanghai) Co., Ltd., Shanghai (CN); NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 98 days.

(21) Appl. No.: 13/953,759

(22) Filed: Jul. 30, 2013

(65) Prior Publication Data

US 2014/0327704 A1 Nov. 6, 2014

(30) Foreign Application Priority Data

May 6, 2013 (CN) ..... 2013 1 0163914

(51) Int. Cl.

| | |
|---|---|
| ***G09G 3/36*** | (2006.01) |
| ***G09G 3/34*** | (2006.01) |
| ***G09G 3/20*** | (2006.01) |

(52) U.S. Cl.

CPC ..... *G09G 3/3406* (2013.01); *G09G 3/2014* (2013.01); *G09G 3/2022* (2013.01); *G09G 2320/0233* (2013.01); *G09G 2320/0646* (2013.01); *G09G 2320/0686* (2013.01)

(58) Field of Classification Search

None

See application file for complete search history.

(56) References Cited

U.S. PATENT DOCUMENTS

| | | | | |
|---|---|---|---|---|
| 2010/0020004 | A1 * | 1/2010 | Smith | 345/102 |
| 2014/0097765 | A1 * | 4/2014 | Hussain et al. | 315/224 |

FOREIGN PATENT DOCUMENTS

| | | |
|---|---|---|
| TW | 200809757 | 2/2008 |
| TW | 200813948 | 3/2008 |
| TW | 200844976 | 11/2008 |
| TW | 200931382 | 7/2009 |
| TW | 200941447 | 10/2009 |

* cited by examiner

*Primary Examiner* — Muhammad N Edun

(74) *Attorney, Agent, or Firm* — Winston Hsu; Scott Margo

(57) ABSTRACT

An intensity compensation method for a display control device includes steps of obtaining a plurality of backlight duties of a plurality of backlights according to an image data; calculating a plurality of compensation gains according to the plurality of backlight duties and a non-uniform backlight profile, wherein the non-uniform backlight profile indicates a plurality of respective actual intensity distributions of the plurality of backlights; and compensating a plurality of first image intensities corresponding to a plurality of pixels of the image data according to the plurality of compensation gains, to obtain a plurality of second image intensities.

16 Claims, 2 Drawing Sheets

INTENSITY COMPENSATION METHOD AND DISPLAY CONTROL DEVICE AND IMAGE DISPLAY DEVICE APPLYING THE SAME

BACKGROUND OF THE INVENTION

1. Field of the Invention

The present invention relates to an intensity compensation method and a display control device and an image display device applying the same, and more particularly, to an intensity compensation method and a display control device and an image display device applying the same for simultaneously compensating the intensity loss due to local dimming and the non-uniformity of the mura panel according to a non-uniform backlight profile in order to display the normal intensity of an image.

2. Description of the Prior Art

In general, the local dimming technology turns on the corresponding display region of a liquid crystal display (LCD) by different backlight intensity, so as to save power consumption.

For example, if an image is brighter in the first display region but darker in the second display region, the local dimming may control the cold cathode fluorescent lamp (CCFL) or the light emitting diode (LED) to turn on with a brighter intensity for the first displayed region while with a darker intensity for the second displayed region. Therefore, compared with turning on all backlight sources with maximum intensity in the normal operation, the local dimming technology can save the power consumption.

In such a condition, since the local dimming technology lower the intensity for parts of the display region, the conventional local dimming technique may further compensate and increase the image intensity (i.e., the polarizing degree for LCD to conducting light) of the image data before displaying the image (i.e., increase the image intensity to compensate the loss induced by lowering the backlight intensity) to prevent the users from being affected by the intensity loss.

On the other hand, in the prior art, when calculating the light leakage from a backlight in a display region that leaks to the other display regions, it is generally assumed that all the backlight sources of the panel are uniform. However, the backlight non-uniformity of the mura panel may result in the intensity non-uniformity. Therefore, a mura compensation is required when applying the local dimming technology to the mura panel.

The conventional technology performs the mura compensation when all the backlight sources are fully turned on. However, the local dimming may not fully turn on the backlight sources. Therefore, the conventional mura compensation may not be effectively applied to the local dimming. Thus, there is a need for improvement of the prior art.

SUMMARY OF THE INVENTION

It is therefore an objective of the present invention to provide an intensity compensation method and a display control device and an image display device thereof for simultaneously compensating the intensity loss due to local dimming and the non-uniformity of the mura panel according to a non-uniform backlight profile.

The present invention discloses an intensity compensation method for a display control device of an image display device. The intensity compensation method includes obtaining a plurality of backlight duty cycles of a plurality of backlights according to an image data; calculating a plurality of compensation gains according to the plurality of backlight duty cycles and a non-uniform backlight profile, wherein the non-uniform backlight profile indicates a plurality of respective actual intensity distributions of the plurality of backlights; and compensating a plurality of first image intensities corresponding to a plurality of pixels of the image data according to the plurality of compensation gains, to obtain a plurality of second image intensities.

The present invention further discloses an intensity compensation method for a display control device of an image display device. The intensity compensation method includes obtaining a plurality of backlight intensities of a plurality of backlights according to an image data; calculating a plurality of compensation gains according to the plurality of backlight intensities and a non-uniform backlight profile, wherein the non-uniform backlight profile indicates a plurality of respective actual intensity distributions of the plurality of backlights; and compensating a plurality of first image intensities corresponding to a plurality of pixels of the image data according to the plurality of compensation gains, to obtain a plurality of second image intensities.

The present invention further discloses a display control device used in an image display device. The display control device is coupled to a backlight driving circuit for receiving an image data and executing the intensity compensation method.

The present invention further discloses an image display device. The image display device includes a display control device for receiving an image data and executing the intensity compensation method; and a panel for receiving control from the display control device for displaying images. The image display device further includes a plurality of backlights; and a backlight driving circuit coupled to the display control device for controlling the plurality of backlights to turn on with a plurality of backlight intensities.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
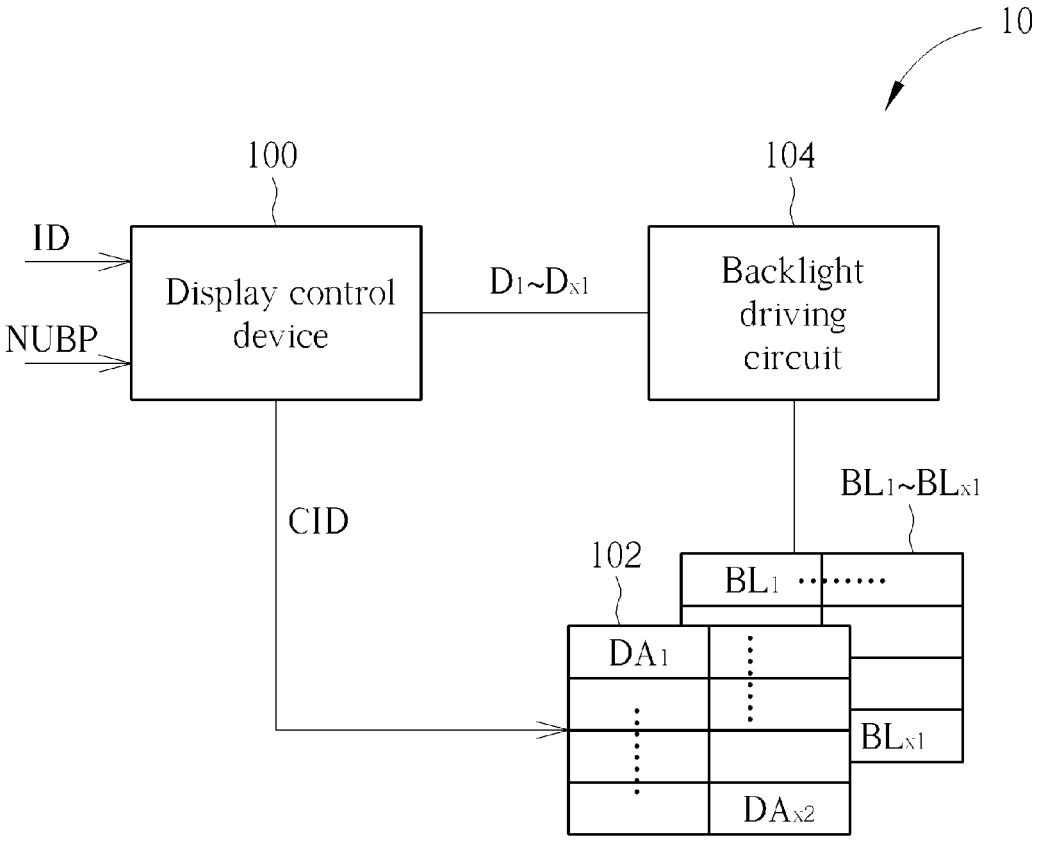
FIG. 1 is a schematic diagram of a liquid crystal display (LCD) according to an embodiment of the present invention.

Please refer to the FIG. 1, which illustrates a schematic diagram of an image display device, for example, a liquid crystal display (LCD) 10, according to an embodiment. As shown in the FIG. 1, the LCD 10 includes a display control device 100 and a panel 102. In addition, the LCD 10 further includes backlight sources $BL_1$-$BL_{x1}$ and a backlight driving circuit 104. The display control device 100 may receive an image data ID and a non-uniform backlight profile data NUBP to perform intensity compensation and then generate a compensated image data CID. The panel 102 may receive control from the display control device 100 to display an image. The backlight sources $BL_1$-$BL_{x1}$ provides the backlights, for example, by light emitting diodes (LEDs). The backlight driving circuit 104 is coupled to the display control device 100, and receives the backlight duty cycles $D_1$-$D_{x1}$ for controlling the backlight sources $BL_1$-$BL_{x1}$ turn on with intensities $BLI_1$-$BLI_{x1}$.

Figure 2:
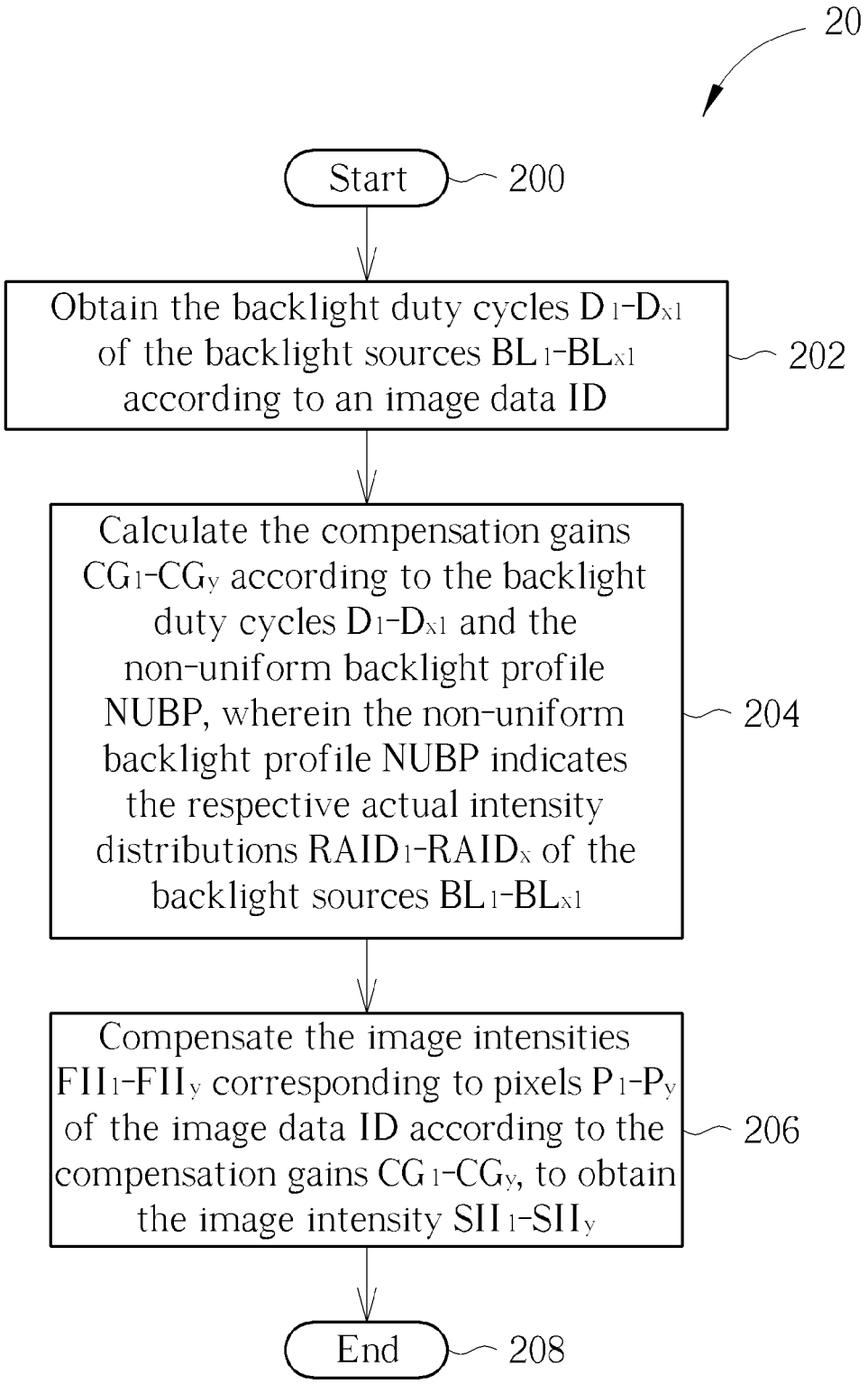
FIG. 2 is a schematic diagram of an intensity compensation process according to an embodiment of the present invention.

In detail, the intensity compensation operation of the display control device 100 can be summarized as an intensity compensation process 20 as shown in the FIG. 2, including the following steps:

Step 200: Start.

Step 202: Obtain the backlight duty cycles $D_1$-$D_{x1}$ of the backlight sources $BL_1$-$BL_{x1}$ according to an image data ID.

Step 204: Calculate the compensation gains $CG_1$-$CG_y$ according to the backlight duty cycles $D_1$-$D_{x1}$ and the non-uniform backlight profile NUBP, wherein the non-uniform backlight profile NUBP indicates the respective actual intensity distributions $RAID_1$-$RAID_x$ of the backlight sources $BL_1$-$BL_{x1}$.

Step 206: Compensate the image intensities $FII_1$-$FII_y$ corresponding to pixels $P_1$-$P_y$ of the image data ID according to the compensation gains $CG_1$-$CG_y$, to obtain the image intensity $SII_1$-$SII_y$.

Step 208: End.

According to the intensity compensation process 20, after receiving the image data ID, the display control device 100 may perform the local dimming to the panel 102 of the LCD 10 according to the image data ID to obtain the backlight duty cycles $D_1$-$D_{x1}$ of the backlight sources $BL_1$-$BL_{x1}$, so as to indicate the driver circuit 104 to utilize the backlight duty cycles $D_1$-$D_{x1}$ to control the backlight sources $BL_1$-$BL_{x1}$ to turn on with the corresponding backlight intensities $BLI_1$-$BLI_{x1}$. For example, the backlight intensities $BLI_1$-$BLI_{x1}$ of the backlight sources $BL_1$-$BL_{x1}$ may be modulated by using the pulse width modulation (PWM) or other manners.

There are various ways to obtain the backlight duty cycles $D_1$-$D_{x1}$ of the backlight sources $BL_1$-$BL_{x1}$. For example, the panel 102 may be partitioned into display regions $DA_1$-$DA_{x2}$. Each of the display region $DA_1$-$DA_{x2}$ contains either same number or different number of one to multiple pixels. The backlight sources $BL_1$-$BL_{x1}$ are corresponding to the display regions $DA_1$-$DA_{x2}$, but are not limited thereto. x1 may or may not be equal to x2. For example, a backlight source may be corresponded to the same or different display regions. The display control device 100 may statistically summarize the maximum image intensity of each pixel in the display regions $DA_1$-$DA_{x2}$ to depict the histogram, and decide the backlight duty cycles $D_1$-$D_{x1}$ of the backlight sources $BL_1$-$BL_{x1}$ according to local image intensities $AII_1$-$AII_{x2}$ of the display regions $DA_1$-$DA_{x2}$ corresponding to the backlight sources $BL_1$-$BL_{x1}$ for the image data ID. Namely, for a display region with brighter local image intensity among the display regions $DA_1$-$DA_{x2}$, the respective backlight source may be turned on with higher backlight duty cycle (higher backlight intensity); on the contrary, for a display region with darker local image intensity among the display regions $DA_1$-$DA_{x2}$, the respective backlight source may be turned on with lower backlight duty cycle (lower backlight intensity) for saving the power. The other conventional ways to obtain the backlight duty cycles $D_1$-$D_{x1}$ of the backlight sources $BL_1$-$BL_{x1}$ according to the image data ID, such as to find out the maximum image intensity point or the average intensity of each display region as a reference value, the mixed methods, or the way which does not consider the display region, may be applied as well.

Next, when an image is displayed in the display regions $DA_1$-$DA_{x2}$, the backlight source of the neighbor display regions may also provide backlights (i.e., the light leakage) to the pixels within the displayed region in addition to the backlight source of the displayed region. Therefore, the display control device 100 need to calculate the compensation gains $CG_1$-$CG_y$ according to the backlight duty cycles $D_1$-$D_{x1}$ and the non-uniform backlight profile NUBP of the backlight sources $BL_1$-$BL_{x1}$, wherein the non-uniform backlight profile NUBP indicates the actual intensity distribution in the panel 102 when the backlight sources $BL_1$-$BL_{x1}$ are fully turned on (backlight duty cycle 100%). For example, the non-uniform backlight profile NUBP may include a plurality of leakage coefficients P(i,j), where the leakage coefficients P(i, j) represent the jth pixel intensity of panel pixels $P_1$-$P_y$ when only the ith backlight source among the backlight sources $BL_1$-$BL_{x1}$ is fully turned on (backlight duty cycle 100%). The leakage coefficients P(i, j) may be obtained from the experiments, for example, by turning on the backlight sources $BL_1$-$BL_{x1}$ in the darkroom with a sequential order before the intensity compensation and then measuring the light leakage of each of the backlight sources for each pixel.

The display control device 100 may determine the respective actual backlight intensity $RABI_j$ (wherein the j can be one of the values from 1 to y) for each pixel according to the leakage coefficients P(i, j) and the backlight duty cycles $D_1$-$D_{x1}$. As to the method of the determination, for example, the display control device 100 may perform a convolution to derive the respective actual backlight intensities $RABI_1$-$RABI_y$ of the pixels $P_1$-$P_y$ according to the backlight duty cycles $D_1$-$D_{x1}$ and the leakage coefficients P(i, j) In other words, when calculating the respective actual backlight intensity $RABI_j$ of the pixel $P_1$, both the backlight intensity generated by the corresponding backlight duty cycle of the backlight source in the display region and the backlight intensities generated by the corresponding backlight duty cycle of the other backlight sources that affect the pixel $P_j$ should be considered to obtain the respective actual backlight intensity $RABI_j$ of the pixel $P_1$, as illustrated below:

$$RABI_j = \sum_{i=1\sim x_1} \left( (D_i \times P(i,\ j)) \Big/ \sum_{i=1\sim x_1} P(i,\ j) \right)$$

$$\text{where } \sum_{i=1\sim x_1} P(i,\ j)$$

represents the summation of different leakage coefficients P(i, j) for different backlights. Note that in other embodiments, the other mathematical computation model may be applied instead of using convolution. Any method for computing the respective actual backlight intensity $RABI_j$ of the pixel $P_j$ that considers both the backlight intensity generated by the corresponding backlight duty cycle of the backlight source in the display region and the backlight intensities generated by the corresponding backlight duty cycle of the other backlight sources that affect the pixel $P_j$ should be within the scope of the present invention. Besides, for simplifying the computation, it is not necessary to consider the effects from all the backlight sources. That is, only the effects from one to several other backlight sources have to be considered.

Next, the compensation gains $CG_1$-$CG_y$ may be obtained according to the respective actual backlight intensity $RABI_j$ of the pixel $P_j$. In the procedure to obtain the compensation gains, preferably, respective maximum backlight intensities $MPABI_1$-$MPABI_y$ for the pixels $P_1$-$P_j$ under the condition that the backlight sources $BL_1$-$BL_{x1}$ are fully turned on may be obtained first. In such a condition, the respective maximum backlight intensity $MPABI_j$ of each pixel $P_j$ is the respective actual backlight intensity $RABI_j$ generated under a 100% backlight duty cycle. The equation is shown as below:

$$MPABI_j = \sum_{i=1\sim x_1}\left((100\% \times P(i,\ j))\Big/\sum_{i=1\sim x_1} P(i,\ j)\right)$$

Noticeably, in order to guarantee the uniformity after the intensity compensation, the values for each $MPABI_j$ may be set to be equal. For example, each $MPABI_j$ may be set to a value of an $MPABI_j$ among all the $MPABI_j$. Then, the compensation gain $CG_j$ is calculated from a ratio between the maximum backlight intensity $MPABI_j$ of the pixel $P_j$ and the respective actual backlight intensity $RABI_j$ of the pixel $P_j$. For example, the compensation gains $CG_1$-$CG_y$ are calculated by dividing the respective maximum backlight intensities $MPABI_1$-$MPABI_y$ by the respective actual backlight intensities $RABI_1$-$RABI_y$.

Next, after compensating the image intensities $FII_1$-$FII_y$ corresponding to the pixels $P_1$-$P_y$ of the image data ID according to the compensation gains $CG_1$-$CG_y$, the compensated image intensities $SII_1$-$SII_y$ are obtained as the compensated image data CID for the panel 102 to display.

From above, the compensation gains $CG_1$-$CG_y$ may be the ratio of the respective maximum backlight intensities $MPABI_1$-$MPABI_y$ under the normal condition to the respective actual backlight intensities $RABI_1$-$RABI_y$ of the non-uniform backlight under the local dimming and the mura panel. Therefore, when multiplying the image intensities $FII_1$-$FII_y$ by the compensation gains $CG_1$-$CG_y$ to obtain the image intensities $SII_1$-$SII_y$ for displaying the compensated image data CID, the displayed image may not become darker or non-uniform induced by the local dimming and the mura panel.

In such a condition, the above embodiments consider the backlight intensity loss for parts of the display region resulted from the local dimming, and also consider the non-uniform backlight of the mura panel to calculate the respective actual backlight intensities $RABI_1$-$RABI_y$. Then, the image intensities $FII_1$-$FII_y$ of the pixels $P_1$-$P_y$ in the display regions $DA_1$-$DA_{x2}$ are multiplied by the compensation gains $CG_1$-$CG_y$ to obtain the image intensities $SII_1$-$SII_y$. Therefore, the backlight intensity loss from the local dimming and the intensity non-uniformity resulted from the non-uniform backlight in the mura panel are accurately compensated by increasing the image intensity (e.g., by intensifying the strength of the source control signal to increase the liquid crystal polarization for light-conductivity of the panel 102). Hence, the displayed image may not become darker or non-uniform induced by the local dimming and the mura panel.

Note that the above embodiments simultaneously consider the backlight intensity loss for parts of the display regions resulted from the local dimming and the intensity non-uniformity resulted from the non-uniform backlight of the mura panel when calculating the respective actual backlight intensities $RABI_1$-$RABI_y$. Then, the image intensity is increased to compensate the backlight intensity loss from the local dimming and the intensity non-uniformity resulted from the non-uniform backlight in the mura panel. Therefore, the displayed image may not become darker or non-uniform induced by the local dimming and the mura panel. Those skilled in the art can make modifications or alterations accordingly. For example, the display control device 100 may integrate different functions by different integration methods. The display control device 100 may control the panel 102 directly to display the compensated image data CID, or a clock controller may be inserted between the display control device 100 and the panel 102. After the clock controller receives the compensated image data CID, the panel 102 may display the compensated image data CID.

Besides, the compensation gains $CG_1$-$CG_{x1}$ may be designed based on specific requirements but not limited to the ratio of the maximum backlight intensities $MPABI_1$-$MPABI_y$ to the respective actual backlight intensities $RABI_1$-$RABI_y$. For example, in the above embodiments, the compensation gains $CG_1$-$CG_{x1}$ are designed as the ratio of the respective maximum backlight intensities $MPABI_1$-$MPABI_y$ to the respective actual backlight intensities $RABI_1$-$RABI_y$ under the normal condition. However, in other embodiments, dividing the respective maximum backlight intensities $MPABI_1$-$MPABI_y$ by the respective actual backlight intensities $RABI_1$-$RABI_y$ can further take advantage of the Gamma characteristic of the panel 102 for generating the compensation gains $CG_1$-$CG_{x1}$. For example, since the intensity trend of the pixels $P_1$-$P_y$ complies with a Gamma curve G, the compensation gains $CG_1$-$CG_{x1}$ are derived by the following equation:

$$MPABI_j/RABI_1\hat{}(1/G)$$

Preferably, in the abovementioned calculation procedures, all $MPABI_j$ may be set to the same value, e.g., identical with one of the $MPABI_j$, in order to ensure the intensity uniformity after the intensity compensation. Note that the Gamma curve G may not be fully accurate, and therefore, a direct measurement may be applied to ensure the accuracy of the compensation gains $CG_1$-$CG_y$ and the intensity uniformity between the turned-on and turned-off regions of the local dimming.

Furthermore, after obtaining the respective actual backlight intensities of the plurality of the pixels, a look-up table may be referenced to obtain a plurality of gains corresponding to the respective actual backlight intensities of the pixels, and then the plurality of gains are used as the compensation gains. Preferably, the look-up table is obtained by measurement, or derived by the calculations as illustrated above (i.e., by dividing the respective maximum backlight intensities $MPABI_1$-$MPABI_y$ by the respective actual backlight intensities $RABI_1$-$RABI_y$ and combining the Gamma characteristic to generate the compensation gains $CG_1$-$CG_y$).

Note that in the embodiments, the backlight intensities $BLI_1$-$BLI_{x1}$ of the backlight sources $BL_1$-$BL_{x1}$ are adjusted by the duty cycles $D_1$-$D_{x1}$ of the backlight sources $BL_1$-$BL_{x1}$, but are not limited thereto. In other embodiments, other ways such as adjusting the amplitude of the control signal (e.g. the driving current) for the backlight sources $BL_1$-$BL_{x1}$, or adjusting the duty cycles and the amplitude together, so as to change the backlight intensities $BLI_1$-$BLI_{x1}$ of the backlight sources $BL_1$-$BL_{x1}$. The subsequent procedures can be similarly derived as abovementioned.

In summary, the way using the image data to obtain the backlight intensity or the backlight duty cycle, plus the intensity distribution data of backlight sources in the panel, to calculate the compensation gain of any pixel, as long as the actual intensity distribution data includes not only the backlight duty cycle of the backlight sources and the actual intensity distribution data corresponding to the pixel that is located in the displayed region, but also the backlight duty cycle and the actual intensity distribution data of one or multiple backlight sources, are covered by present invention. From the other perspective, when calculating the compensation gain of every single pixel within a plurality of pixels (at least one pixel), the compensation gain of a given pixel is calculated according to at least one backlight duty cycle within a plurality of duty cycles.

In the prior art, the mura compensation is performed when all the backlight sources are fully turned on. However, when the backlight sources are partially turned on for the local dimming, the conventional mura compensation may not be effectively operated. In comparison, the above embodiments of the present invention may simultaneously consider the backlight intensity loss for part of the display region resulted from the local dimming and the intensity non-uniformity resulted from the non-uniform backlight of the mura panel for calculating the respective actual backlight intensities $RABI_1$-$RABI_y$. Then, the image intensity is enhanced to compensate the backlight intensity loss from the local dimming and the intensity non-uniformity resulted from the non-uniform backlight in the mura panel. Therefore, the displayed image may not become darker or non-uniform induced by the local dimming and the mura panel.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An intensity compensation method for a display control device of an image display device, comprising:

obtaining a plurality of backlight duty cycles, or a plurality of backlight intensities, of a plurality of backlight sources according to a plurality of image intensities for an image data;

obtaining a plurality of compensation gains for a plurality of pixels with respect to the image data, according to a plurality of respective actual backlight intensities, wherein each respective actual backlight intensity is corresponding to one of the pixels of the image data and is determined based on:

at least two of the backlight duty cycles, which are respectively corresponding to a first backlight source and a second backlight source at least, of the backlight sources, and a plurality of backlight intensities corresponding to the pixels, which are measured when the first and the second backlight sources are respectively turned on with corresponding backlight duty cycles; and compensating a plurality of first image intensities corresponding to the plurality of pixels of the image data according to the plurality of compensation gains, to obtain a plurality of second image intensities.

2. The intensity compensation method of claim 1, wherein the step of obtaining the plurality of compensation gains for the plurality of pixels with respect to the image data according to the respective actual backlight intensities at the plurality of pixels comprises:

calculating a plurality of respective maximum backlight intensities at the plurality of pixels which are measured under a condition that all of the plurality of backlight sources are respectively fully turned on; and calculating the plurality of compensation gains according to the plurality of respective maximum backlight intensities and the respective actual backlight intensities at the plurality of pixels.

3. The intensity compensation method of claim 2, wherein the step of calculating the plurality of compensation gains according to the plurality of respective maximum backlight intensities and the respective actual backlight intensities at the plurality of pixels comprises:

dividing the plurality of respective maximum backlight intensities by the respective actual backlight intensities at the plurality of pixels, respectively, to obtain the plurality of compensation gains.

4. The intensity compensation method of claim 3, wherein the step of calculating the plurality of compensation gains according to the plurality of respective maximum backlight intensities and the respective actual backlight intensities at the plurality of pixels further comprises:

combining a Gamma characteristic of a panel after dividing the plurality of respective maximum backlight intensities by the respective actual backlight intensities, to obtain the plurality of compensation gains.

5. The intensity compensation method of claim 1, wherein the step of obtaining the plurality of compensation gains for the plurality of pixels with respect to the image data according to the respective actual backlight intensities at the plurality of pixels comprises:

referring to a look-up table according to the respective actual backlight intensities at the plurality of pixels, to obtain a plurality of gains corresponding to the respective actual backlight intensities at the plurality of pixels and take the plurality of gains as the plurality of compensation gains.

6. The intensity compensation method of claim 1, wherein each of the plurality of backlight intensities of the plurality of backlight sources is determined based on the backlight duty cycle of a corresponding one of the plurality of backlight sources and the amplitude of a control signal of the corresponding backlight source.

7. The intensity compensation method of claim 1, wherein for the respective actual backlight intensity for a pixel, one of the first and the second backlight sources is corresponding to a first display region where the pixel is, and the other of the first and the second backlight sources is corresponding to another display region other than the first display region.

8. The intensity compensation method of claim 1, wherein the plurality of image intensities for the image data according to which the plurality of backlight duty cycles are obtained are local image intensities of a plurality of display regions for the image data.

9. An image display device, comprising:

a plurality of backlight sources;

a backlight driving circuit, configured to control the plurality of backlight sources with a plurality of backlight duty cycles;

a display control device, coupled to the backlight driving circuit, and configured to:

obtaining the plurality of backlight duty cycles, or a plurality of backlight intensities, of the plurality of backlight sources according to a plurality of image intensities for an image data;

obtaining a plurality of compensation gains for a plurality of pixels with respect to the image data, according to a plurality of respective actual backlight intensities, wherein each respective actual backlight intensity is corresponding to one of the pixels of the image data and is determined based on:

at least two of the backlight duty cycles, which are respectively corresponding to a first backlight source and a second backlight source at least, of the backlight sources, and a plurality of backlight intensities corresponding to the pixels, which are measured when the first and the second backlight sources are respectively turned on with corresponding backlight duty cycles; and compensating a plurality of first image intensities corresponding to the plurality of pixels of the image data according to the plurality of compensation gains, to obtain a plurality of second image intensities; and a panel, for displaying the image data with the plurality of second image intensities.

10. The image display device of claim 9, wherein each of the plurality of backlight intensities of the plurality of backlight sources is determined based on the backlight duty cycle of a corresponding one of the plurality of backlight sources and the amplitude of a control signal of the corresponding backlight source.

11. The image display device of claim 9, wherein for the respective actual backlight intensity for a pixel, one of the first and the second backlight sources is corresponding to a first display region where the pixel is, and the other of the first and the second backlight sources is corresponding to another display region other than the first display region.

12. The image display device of claim 9, wherein the plurality of image intensities for the image data according to which the plurality of backlight duty cycles are obtained are local image intensities of a plurality of display regions for the image data.

13. The image display device of claim 9, wherein the display control device obtains the plurality of compensation gains by calculating a plurality of respective maximum backlight intensities at the plurality of pixels which are measured under a condition that all of the plurality of backlight sources are respectively fully turned on, and calculating the plurality of compensation gains according to the plurality of respective maximum backlight intensities and the respective actual backlight intensities at the plurality of pixels.

14. The image display device of claim 13, wherein the display control device divides the plurality of respective maximum backlight intensities by the respective actual backlight intensities at the plurality of pixels, respectively, so as to obtain the plurality of compensation gains.

15. The image display device of claim 14, wherein the display control device combines a Gamma characteristic of a panel after dividing the plurality of respective maximum backlight intensities by the respective actual backlight intensities, so as to obtain the plurality of compensation gains.

16. The image display device of claim 9, wherein display control device refers to a look-up table according to the respective actual backlight intensities at the plurality of pixels, to obtain a plurality of gains corresponding to the respective actual backlight intensities at the plurality of pixels, and takes the plurality of gains as the plurality of compensation gains.

* * * * *